US010660397B1

(12) United States Patent
Graham et al.

(10) Patent No.: US 10,660,397 B1
(45) Date of Patent: May 26, 2020

(54) INTERCHANGEABLE HEEL MEMBER

(71) Applicants: Sharon A. Graham, Miramar, FL (US); Carl A. Hay, Miramar, FL (US)

(72) Inventors: Sharon A. Graham, Miramar, FL (US); Carl A. Hay, Miramar, FL (US)

( * ) Notice: Subject to any disclaimer, the term of this patent is extended or adjusted under 35 U.S.C. 154(b) by 94 days.

(21) Appl. No.: 15/862,361

(22) Filed: Jan. 4, 2018

(51) Int. Cl.
*A43B 3/24* (2006.01)
*A43B 21/48* (2006.01)
*A43B 21/42* (2006.01)

(52) U.S. Cl.
CPC ..... *A43B 3/24* (2013.01); *A43B 21/42* (2013.01); *A43B 21/48* (2013.01)

(58) Field of Classification Search
CPC ..... A43B 21/52; A43B 21/51; A43B 21/47; A43B 21/46; A43B 21/42; A43B 21/37; A43B 21/30; A43B 3/24; A43B 21/48
See application file for complete search history.

(56) References Cited

U.S. PATENT DOCUMENTS 1,743,543 A * 1/1930 Gutierrez ..... A43B 21/48 36/42
1,829,252 A * 10/1931 Zubia ..... A43B 21/36 36/42
2,795,866 A * 6/1957 Perugia ..... A43B 13/34 36/24.5
4,670,996 A * 6/1987 Dill ..... A43B 21/50 36/36 C
5,133,138 A * 7/1992 Durcho ..... A43B 1/0054 36/100
7,185,448 B2 3/2007 Schupbach
7,434,335 B2 * 10/2008 Feldstein ..... A43B 5/12 36/15
9,220,317 B2 12/2015 Green

* cited by examiner

*Primary Examiner* — Sharon M Prange
*Assistant Examiner* — Erick I Lopez
(74) *Attorney, Agent, or Firm* — Sanchelima & Associates, P.A.; Christian Sanchelima; Jesus Sanchelima

(57) ABSTRACT

An interchangeable heel member comprising a locking mechanism is provided. The locking mechanism comprises a pin member operated by a button. The interchangeable heel member is coupled to a shoe by means of the pin member. The shoe comprises a groove provided at a heel plate. The pin member is made to fit in the groove to hold the interchangeable heel member to the shoe. In order to remove the interchangeable heel member from the shoe, the button is pressed and the pin member is released from the groove. The interchangeable heel member is replaced with replacement heels that differ in height or diameter.

10 Claims, 4 Drawing Sheets

INTERCHANGEABLE HEEL MEMBER

FIELD OF THE INVENTION

The present invention relates to heel members and, more particularly, to heel members that can be interchanged with shoe.

DESCRIPTION OF THE RELATED ART

It is very well known that women like to wear different shoes depending upon occasion. In order to wear different shoes for different occasions, women may have to buy multiple shoes. This is because; each shoe may have a different design or have a heel that is too short or too high. Buying multiple shoes is expensive. Further, having multiple shoes may take space at home or when travelling.

In order to overcome the problems of buying and storing multiple shoes, several designs of shoes having interchangeable heels have been proposed in the past. For example, Utility U.S. Pat. No. 7,185,448 discloses a shoe with interchangeable heel members having blade portions with predetermined slope.

In another example, Utility U.S. Pat. No. 9,220,317 discloses a shoe with a replaceable screw-on heel.

While the designs have solved the intended purpose to interchange heel members, none of the above references disclose an interchangeable heel member comprising a locking mechanism that is similar to the present disclosure. The interchangeable heel members disclosed in the above references and other known mechanisms, it is not easy to engage and disengage the heel member from the shoe. Further, when the heel member is locked with the shoe, due to the lack of proper locking mechanism, the heel member may not support the weight and provide stability. For the above reasons, known interchangeable heel member designs are not effective for prolonged use and may have to be replaced. Replacing shoe or the interchange heel members may become costly.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an interchangeable heel member comprising a locking mechanism to lock the heel member to a shoe that can be used in both men's and women's shoe.

It is another object of this invention to provide an interchangeable heel member comprising a locking mechanism. Further, the locking mechanism comprises a button to release the pin member.

It is still another object of the present invention to provide a shoe comprising a groove provided at a heel plate. In one example, the groove comprises a loop type hook. The interchangeable heel member is coupled to the shoe by means of the pin member. Specifically, the pin member is made to fit in the groove to hold the interchangeable heel member. In order to remove the interchangeable heel member from the shoe, the button is pressed and the pin member is retracted from the groove. The interchangeable heel member may be replaced with replacement heels that differ in height or diameter so that one can replace the interchangeable heel member with other replacement heels.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

Figure 1:
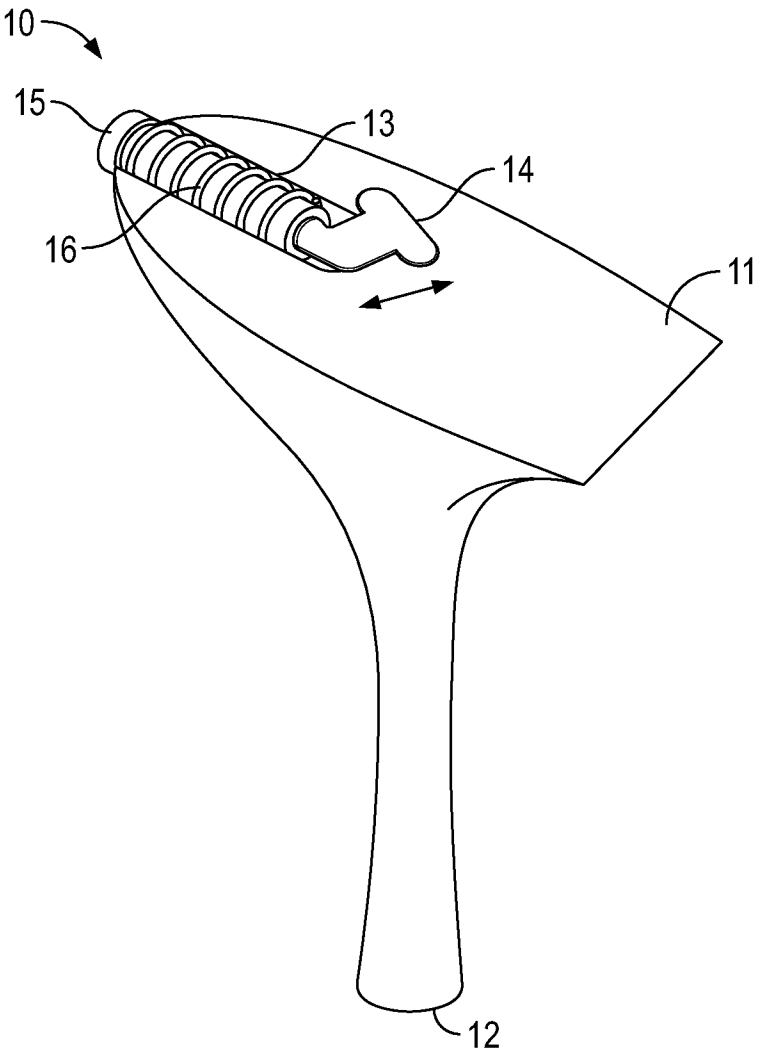
FIG. 1 illustrates a perspective view of an interchangeable heel member, in accordance with one embodiment of the present disclosure.

Referring now to FIG. 1, a perspective view of an interchangeable heel member 10 is shown, in accordance with one embodiment of the present disclosure. The interchangeable heel member 10 comprises a first end 11 and a second end 12. The first end 11 is typically a flat surface and includes a locking assembly. First end 11 or the flat surface may include a cavity or a recessed cavity to receive the locking assembly therein. The locking assembly may be located on the flat surface towards a rearmost periphery of the flat surface. The locking assembly may include a locking mechanism 13. In one example, the first end 11 may have a tapered surface depending on the need. Further, the locking assembly may include a pin member 14. Further, the locking assembly may include a button 15 coupled to the pin member 14 via a spring member 16. Specifically, the spring member 16 may be provided in between the pin member 14 and the button 15 such that when the button 15 is pressed, the spring member 16 may actuate or pull down or retract the pin member 14. The button 15 may be protrude outwardly beyond the rearmost periphery of the flat surface at an outer surface of the interchangeable heel member 10. In one example, the pin member 14 may be made to move up or down upon pressing the button 15. In one example, the button 15 is provided on outer surface of the interchangeable heel member 10 such that a wearer may press the button 15 to retract the pin member 14. In other words, the button 15 is pressed to retract the pin member 14 to unlock the pin member 14 when locked with other component i.e., its locking position. The second end 12 of the interchangeable heel member 10 has a substantially flat surface that will be in contact with the ground when the wearer walks with the interchangeable heel member 10. It should be understood that the locking assembly may include the locking mechanism 13, the pin member 14, the button 15 and the spring member 16.

Figure 2:
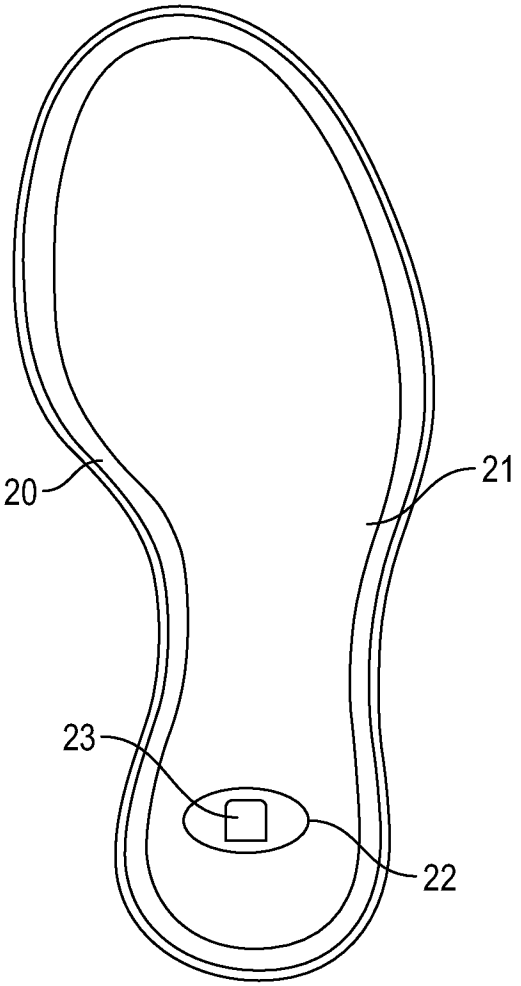
FIG. 2 shows a shoe comprising a groove, in accordance with one exemplary embodiment of the present disclosure.

Referring to FIG. 2, a bottom view of a shoe 20 is shown, in accordance with one embodiment of the present disclosure. As can be seen, the shoe 20 comprises a heel plate 21 provided at bottom surface. In one example, the heel plate 21 is provided as an integral part of a sole (not shown) of the shoe 20. In another example, the heel plate 21 is glued, nailed or tacked to the sole by known methods used in the shoe industry. In the current embodiment, the heel plate 21 comprises a groove 22 provided on its surface. The groove 22 may comprise a loop type hook 23 that acts a female member to receive an external component in its area. In other words, when an external component is inserted by applying pressure, the loop type hook 23 allows the external component to enter its body and locks the external component, and releases when the pressure is applied to pull the external component. It should be understood that groove 22 and loop type hook 23 may also be referred to as at least one groove and at least one hook, respectively, in the case that there is more than one of groove 22 and loop type hook 23. Each of groove 22 or at least one groove may include a groove length and a groove width. Each of loop type hook 23 or at least one hook may include a hook length and a hook width. In one embodiment, the groove length and the groove width may be greater than the hook length and the hook width. Preferably, groove 22 or at least one groove may be oval shaped.

Now, referring to FIG. 1 and FIG. 2, an operation of the interchangeable heel member 10 when coupled to the shoe 20 is explained. In operation, the heel plate 21 is made to receive the interchangeable heel member 10 through the groove 22. It should be understood that the locking mechanism 13 is designed such that the locking mechanism 13 is aligned with the groove 22 when brought together. In order to lock the interchangeable heel member 10 with the shoe 20, the pin member 14 is aligned with the groove 22. Specifically, the pin member 14 is aligned with the loop type hook 23. Subsequently, the pin member 14 is made to enter the loop type hook 23. After locking, the pin member 14 ensures that the interchangeable heel member 10 is locked with the shoe 20. In order to remove the interchangeable heel member 10 from the shoe 20, the wearer may press the button 15 to retract the pin member 14 from the loop type hook 23 and the interchangeable heel member 10 may be removed. The wearer may repeat the above procedure to add a new interchangeable heel member to the shoe and such implementation should be obvious to a person skilled in the art.

Figure 3A:
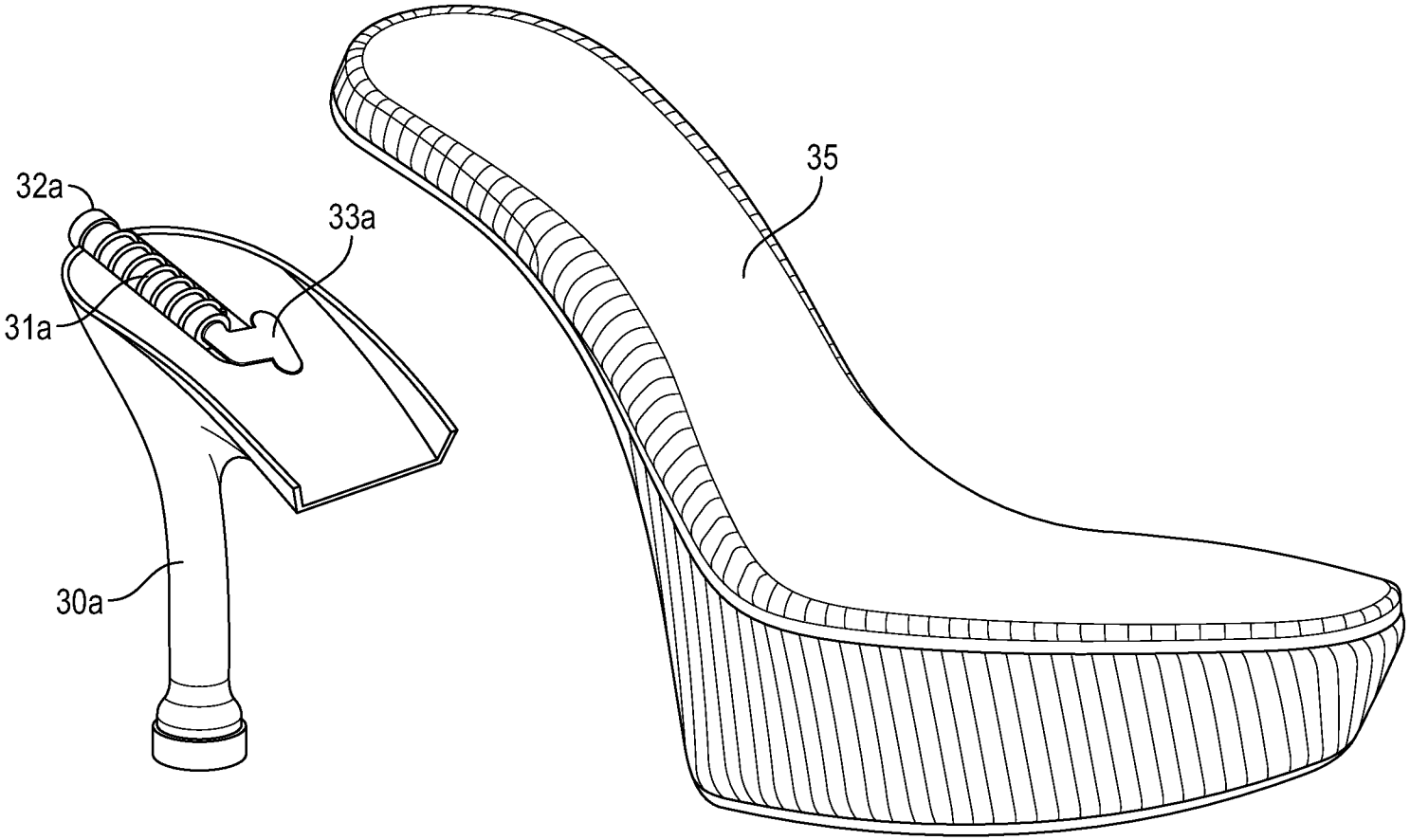
FIGS. 3A and 3B illustrate a shoe with interchangeable heel members having different height and diameter, in accordance with another exemplary embodiment of the present disclosure.
Figure 3B:
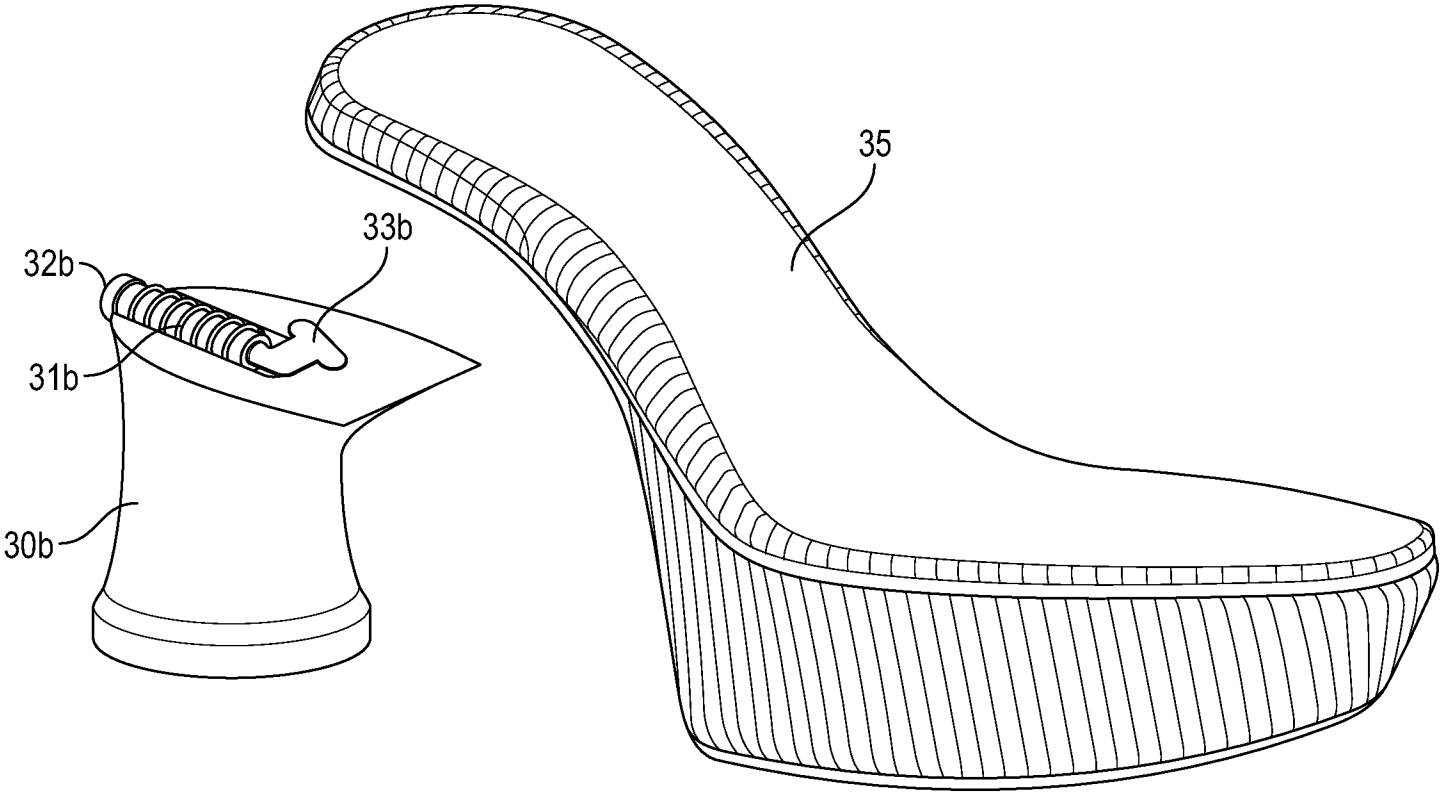

Referring to FIGS. 3A and 3B, a mechanism of interchanging a heel member without changing a shoe is explained. Referring to FIG. 3A, an interchangeable heel member 30*a* coupled to a shoe 35 is shown. The interchangeable heel member 30*a* comprises a locking mechanism 31*a*. The locking mechanism 31*a* comprises a button 32*a* (similar to button 15 shown in FIG. 1). Further, the locking mechanism 31*a* comprises a pin member 33*a*. In one example, the button 32*a* may be coupled to the pin member 33*a* via a spring member or any other component. The interchangeable heel member 30*a* may be coupled to the shoe 35 through a groove (not shown, similar to groove 22 shown in FIG. 2). Now referring to FIG. 3B, same shoe 35 shown in FIG. 3A is presented with a replacement heel member i.e., an interchangeable heel member 30*b*. The interchangeable heel member 30*b* comprises a locking mechanism 31*b*. The locking mechanism 31*b* comprises a button 32*b* (similar to button 15 shown in FIG. 1). Further, the locking mechanism 33*b* comprises a pin member 33*b* (similar to pin member 14 shown in FIG. 1). The interchangeable heel member 30*b* is different from the interchangeable heel member 30*a* in height and diameter so that the wearer can replace the interchangeable heel member 30*a* with the interchangeable heel member 30*b* without having to change the shoe 35.

Figure 4:
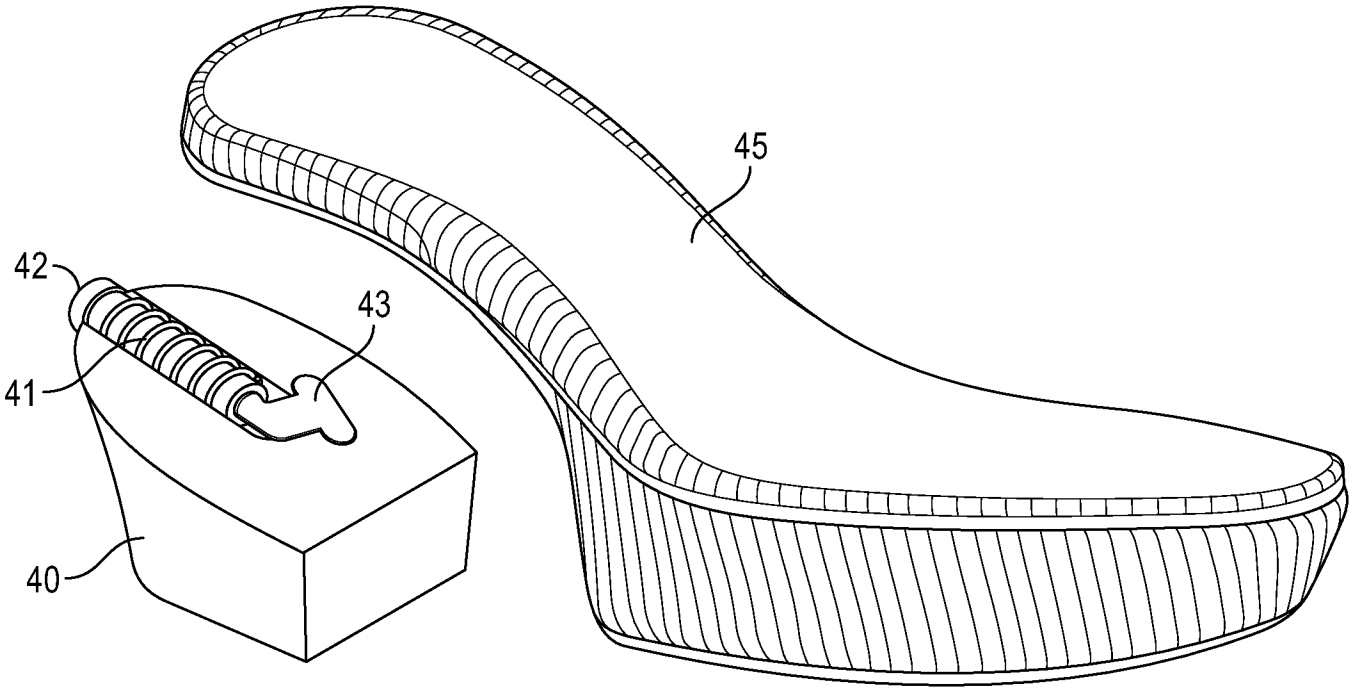
FIG. 4 illustrates a shoe with interchangeable heel members, in accordance with another exemplary embodiment of the present disclosure.

Now referring to FIG. 4, an interchangeable heel member 40 coupled to a shoe 45 is shown. The interchangeable heel member 40 comprises a locking mechanism 41. The locking mechanism 41 comprises a button 42 (similar to button 15 shown in FIG. 1). Further, the locking mechanism 41 comprises a pin member 43 (similar to pin member 14 shown in FIG. 1). The interchangeable heel member 40 may be coupled to the shoe 45 through a groove (not shown, similar to groove 22 shown in FIG. 2). The purpose of the FIG. 4 is to illustrate the different shape and size i.e., height and diameter of the interchangeable heel member 40 that can be replaced as per the requirement of the wearer without having to change the shoe 45.

It should be understood that the interchangeable heel member (10, 30*a*, 30*b*, and 40) presented in the present disclosure is for illustrative purposes only and the interchangeable heel members can be used for both men and women shoes. Further, it should be obvious to a person skilled in the art that interchangeable heel member with different material, height and diameter may be provided with the locking mechanism to lock the interchangeable heel member to the shoe. For example, the shoes depicted in this invention can contain the same materials as in conventional shoes with either leather or plastic type uppers. The interchangeable heel member can be made of wood, aluminum, steel, or plastic material known in the shoe trade. The interchangeable heel member provided may be of any color or size as desired by the wearer so that various combinations of shoes can be utilized. Typical interchangeable heel member for the shoe could vary in height increments by ¼ inch and could start at ⅞ inches and extend to 4¾ inches or possibly higher in exaggerated styles.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shoe having an interchangeable heel, comprising:

a. a shoe being modular ladies' footwear;

b. a heel plate being a shoe platform;

c. removable and interchangeable heel members each having a first end and a second end, said first end being a flat surface having a length;

d. a locking assembly located on said flat surface toward a rearmost periphery of said flat surface, said locking assembly recessed within a recessed cavity of said flat surface, said locking assembly extending along at least a half portion of said length of said flat surface;

e. said locking assembly including a locking mechanism, a button, a spring member and a pin member, said button protruding outwardly beyond the rearmost periphery of said flat surface at an outer surface of said removable heel members, said spring member mounted therebetween said button and said pin member, said locking mechanism and said spring being located within said recessed cavity, said pin member having a distal end and distalmost end being above said recessed cavity;

f. said locking assembly configured to push the pin member in or out of said heel plate upon said button being actuated towards a toe portion of said shoe;

g. said heel plate having a talus end;

h. at least one groove and at least one hook located at said talus end, said at least one groove having a groove length and a groove width, said at least one hook having a hook length and a hook width, said groove length and said groove width being greater than said hook length and hook width, said at least one groove being oval shaped, said at least one hook being located at a center of said at least one groove; and i. said pin member adapted to slide in and out of said at least one hook when said button is actuated thereby locking or unlocking said heel members to said heel plate.

2. The shoe of claim 1 wherein said first end has a tapered surface.

3. The shoe of claim 1 wherein said at least one hook is adapted to act as a female attachment member.

4. The shoe of claim 1 wherein said shoe includes a sole and said heel plate is removably mounted to the sole of said shoe.

5. The shoe of claim 4 wherein said heel plate is glued, nailed, or tacked to said sole.

6. The shoe of claim 1 wherein said distal end of said pin member is at a 90 degree or obtuse angle with respect to the remaining portion of said pin member.

7. The shoe of claim 6 wherein said distalmost end is perpendicularly mounted to said distal end and defines a T-shape with said distal end.

8. The shoe of claim 7 wherein said distalmost end is adapted to be inserted into said at least one hook.

9. The shoe of claim 7 wherein said distalmost end has a first and second end opposite each other and both perpendicular to said distal end, either of said first or second end used to catch said at least one hook.

10. The shoe of claim 9 wherein the toe portion and said first or second end are pushed towards said toe portion using said button until at least one of said first or second end passes said at least one hook, upon said button being released, said spring member urges said pin member to retract and said first or second end catch said at least one hook, thereby locking said heel members to said heel plate.

* * * * *